US010189602B2

(12) United States Patent
Heinrichs

(10) Patent No.: US 10,189,602 B2
(45) Date of Patent: Jan. 29, 2019

(54) PRODUCT TAG WITH EXPANDABLE LOOP AND SACHET

(71) Applicant: Bedford Industries, Inc., Worthington, MN (US)

(72) Inventor: Curtis J. Heinrichs, Sibley, IA (US)

(73) Assignee: Bedford Industries, Inc., Worthington, MN (US)

( * ) Notice: Subject to any disclaimer, the term of this patent is extended or adjusted under 35 U.S.C. 154(b) by 371 days.

(21) Appl. No.: 15/057,529

(22) Filed: Mar. 1, 2016

(65) Prior Publication Data

US 2016/0176575 A1 Jun. 23, 2016

Related U.S. Application Data

(62) Division of application No. 14/112,310, filed as application No. PCT/US2012/033519 on Apr. 13, 2012, now Pat. No. 9,309,037.

(60) Provisional application No. 61/477,431, filed on Apr. 20, 2011.

(51) Int. Cl.

| | |
|---|---|
| ***B65D 23/12*** | (2006.01) |
| ***B65D 75/56*** | (2006.01) |
| ***B65D 23/14*** | (2006.01) |
| ***B65D 79/00*** | (2006.01) |
| ***B65D 75/06*** | (2006.01) |
| ***B65D 75/26*** | (2006.01) |
| ***B65D 75/52*** | (2006.01) |

(52) U.S. Cl.

CPC ..... *B65D 23/12* (2013.01); *B65D 23/14* (2013.01); *B65D 75/06* (2013.01); *B65D 75/26* (2013.01); *B65D 75/522* (2013.01); *B65D 75/527* (2013.01); *B65D 75/56* (2013.01); *B65D 75/563* (2013.01); *B65D 79/00* (2013.01)

(58) Field of Classification Search

CPC ..... B65D 79/00; B65D 23/12; B65D 75/56; B65D 75/563; B65D 5/28; A45F 2005/008; G09F 3/14; G09F 31/10

USPC ..... 40/665, 668, 669, 306; 53/467, 413

See application file for complete search history.

(56) References Cited

U.S. PATENT DOCUMENTS

| | | | | |
|---|---|---|---|---|
| 5,979,144 | A * | 11/1999 | Bailey | B65B 9/02 53/134.2 |
| 6,749,916 | B1 * | 6/2004 | Matthews | G09F 3/02 281/2 |
| 7,836,622 | B1 * | 11/2010 | King | G09F 3/14 206/820 |
| 2005/0166439 | A1 * | 8/2005 | Ludlow | G09F 3/14 40/665 |
| 2010/0139133 | A1 * | 6/2010 | Adams | G09F 3/04 40/299.01 |
| 2012/0019385 | A1 * | 1/2012 | Brodzik | G08B 13/2434 340/572.9 |

* cited by examiner

*Primary Examiner* — Nathaniel Chukwurah

(74) *Attorney, Agent, or Firm* — Mai-Tram D. Lauer; Westman, Champlin & Koehler, P.A.

(57) ABSTRACT

A product tag comprising a sachet portion having a sealed interior, and an elastomer portion bonded to the sachet portion and having an expandable loop.

20 Claims, 14 Drawing Sheets

(Front)

(Rear)

(Front)

(Rear)

(Front)

(Rear)

FIG. 13
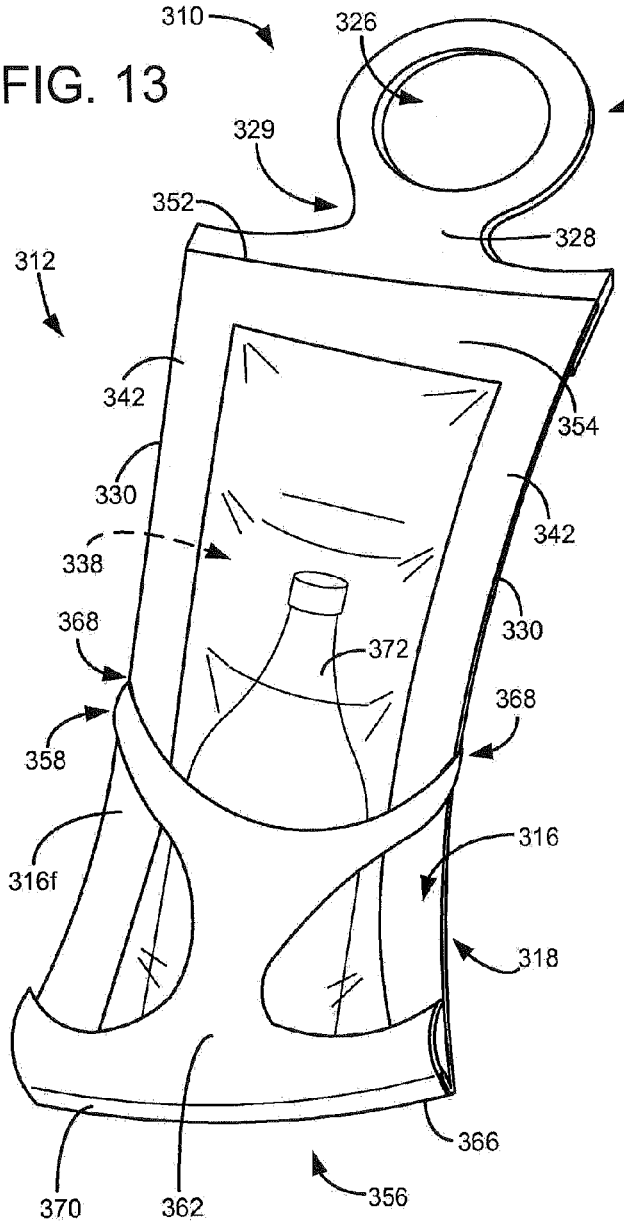
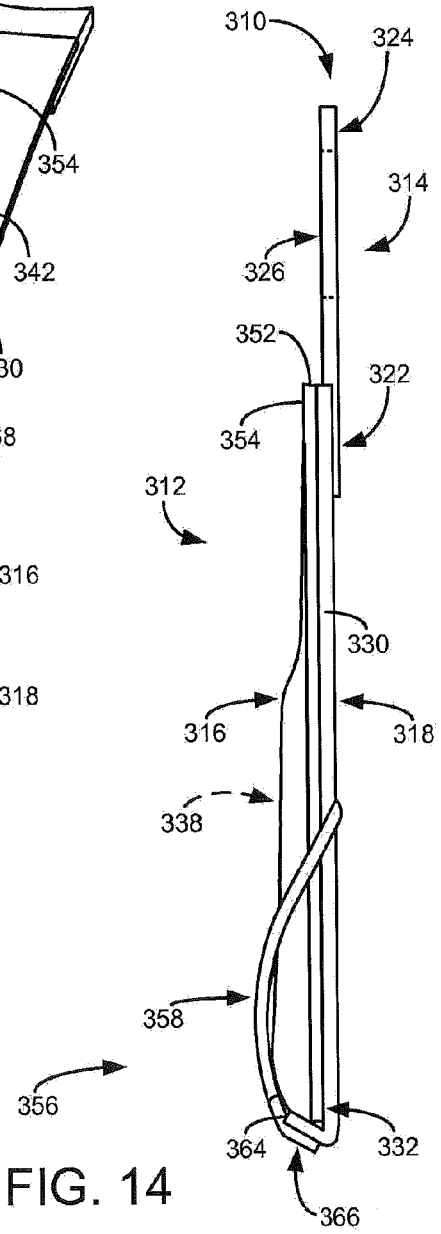
FIG. 14

PRODUCT TAG WITH EXPANDABLE LOOP AND SACHET

CROSS-REFERENCE TO RELATED APPLICATION(S)

This application is a divisional of copending U.S. patent application No. Ser. 14/112,310, filed on Oct. 17, 2013, which is a 371 National Stage Application of International Application No. PCT/US2012/033519, filed on Apr. 13, 2012, published as International Publication No. WO2012/145239, which claims the benefit of priority to U.S. Provisional Patent Application No. 61/477,431, filed on Apr. 20, 2011.

BACKGROUND

The present disclosure relates to a product tag and in particular to a product tag with an expandable loop and a sachet, and a method for manufacturing the product tag.

Tags can be fastened to various manufactured products and other articles to convey information. Such tags can be pre-printed with text or other information or include other indicia or distinguishing features. Depending upon the application and design, tags are attached to various articles using different attachments. Often times the attachment or tag may be difficult to remove from the article or product, or the tag may not meet the specification requirements for the product or article.

SUMMARY

The present disclosure is directed to a product tag having a sachet portion and an elastomer portion. The sachet portion includes a front segment having a front surface and a rear surface, and a rear segment having a front surface and a rear surface, where the front surface of the rear segment is sealed to the rear surface of the front segment to define a sealed interior region. The elastomer portion includes a bonding segment bonded to the rear surface of the rear segment, a transition portion extending from the bonding segment, and an expandable loop extending from the transition portion.

Another aspect of the present disclosure is directed to a method for manufacturing multiple product tags. The method includes advancing a web of a material in a longitudinal direction, where the web has a front segment and a rear segment, and where a front surface of the rear segment faces a rear surface of the front segment. The method also includes sealing portions of the front segment to portions of the rear segment to define multiple sachet portions having interior regions, where each sachet portion is partially unsealed to provide access to the interior region. The method further includes laminating an elastomer film to a rear surface of the rear segment of the web to form a bonding zone between the elastomer film and the rear surface of the rear segment, and cutting the laminated elastomer film to form multiple expandable loops. The method further includes forming lines of weakness in the front segment and rear segment of the web at the sealed portions to define the multiple product tags, where each of the multiple labeling tags includes one of the sachet portions and one of the expandable loops.

Another aspect of the present disclosure is directed to a method for providing a filled product tag. The method includes providing an unsealed product tag having an expandable loop bonded to a sachet portion, where the sachet portion comprises a first segment partially sealed to a second segment to define an interior region, and where the sachet portion is partially unsealed to provide access to the interior region. The method also includes filling the interior region of the sachet portion with a material, and fully sealing the sachet portion retaining the filled material.

This summary is provided to introduce a selection of one or more concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

FIG. 13 is a perspective illustration of the second alternative product tag in use with an article.

FIG. 14 is a side view of the second alternative product tag in use.

Although the above-identified figures set forth various features of the disclosed subject matter, other combinations of features are also contemplated, as noted in the disclosure. In all cases, this disclosure presents the disclosed subject matter by way of representation and not limitation. It should be understood that numerous other modifications and feature combinations can be devised by those skilled in the art which fall within the scope and spirit of the principles of this disclosure. It should be understood that the figures have not been drawn to scale as it has been necessary to enlarge certain portions for clarity of illustration.

DETAILED DESCRIPTION

Figure 1:
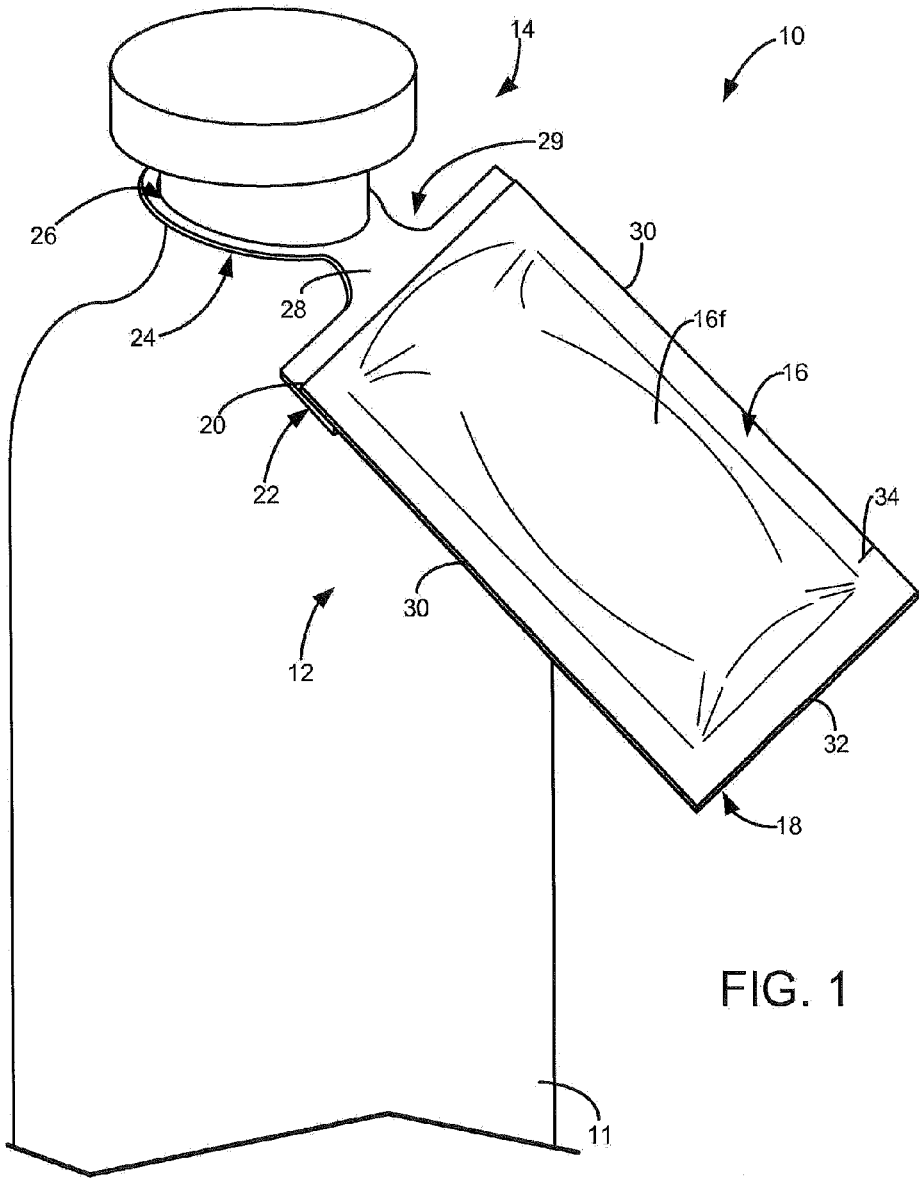
FIG. 1 is a perspective illustration of a product tag of the present disclosure in use with a bottle, where the product tag includes an expandable loop and a sachet portion.

The present disclosure is directed to product tags for retaining a variety of different product samples. The product tags may be secured to retail products to display information (such as human or machine-readable indicia), and also include samples of the same or different retail products. For example, as shown in FIG. 1, tag 10 is an example of a product tag of the present disclosure, which is secured to bottle 11. Bottle 11 may contain any suitable product (e.g., a shampoo product). Tag 10 may accordingly retain a sample of a related product (e.g., a conditioner product) that the producer may wish a consumer to try in combination with the product in bottle 11. Although the present disclosure recites a variety of illustrative uses for the product tags, use is not limited to the specific applications described.

Figure 2:
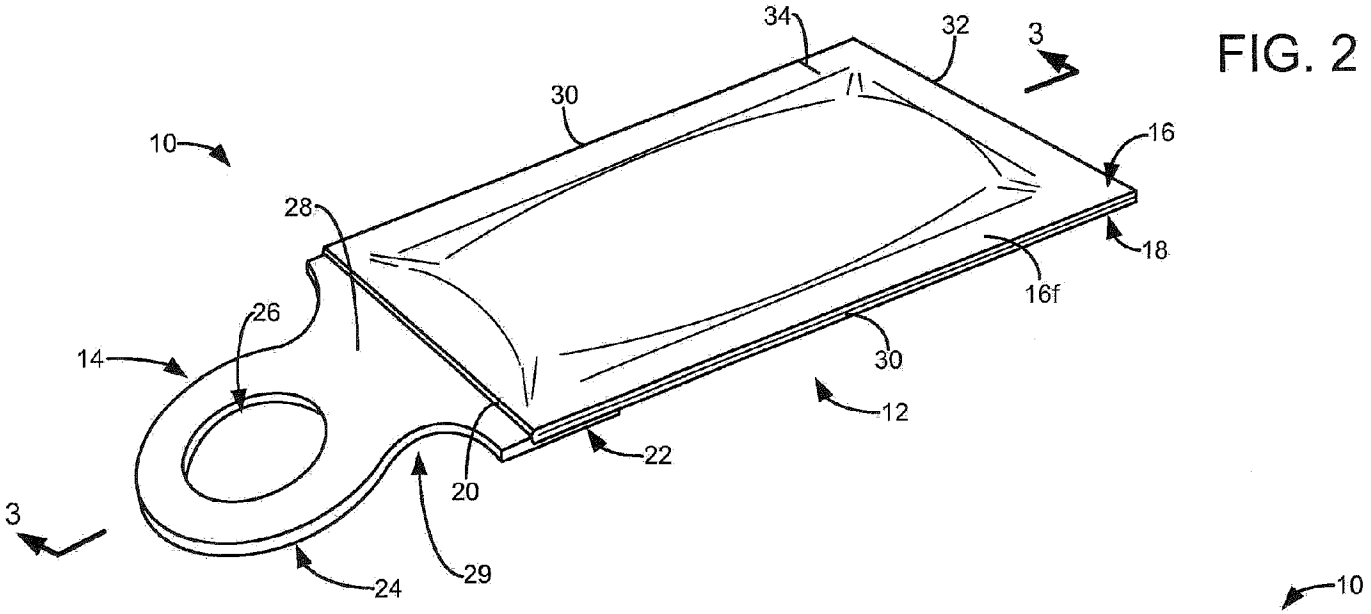
FIG. 2 is a perspective illustration of the product tag.

As shown in FIGS. 1 and 2, tag 10 includes sachet 12 and elastomer portion 14. Sachet 12 has an interior portion or cavity that is suitable for retaining one or more items or product samples, such as samples of lotions, condiments or other food products, powder-based samples (e.g., powdered flavorants), liquid flavorants, shampoos, conditioners, creams, perfumes, and the like. This allows tag 10 to display information on sachet 12, such as information relating to a product, and include samples within sachet 12, such as samples of the product.

Sachet 12 includes front segment 16 and rear segment 18, which are bi-fold segments formed from a single sheet and folded at fold line 20. Front segment 16 includes front surface 16*f* and a rear surface (not shown in FIG. 1 or 2), and rear segment 18 includes front and rear surfaces (not shown in FIG. 1 or 2), where the front surface of rear segment 18 is sealed to the rear surface of front segment 16, as discussed below.

The sheet for front segment 16 and rear segment 18 may be derived from one or more polymeric and/or metallic materials, and are desirably suitable for receiving printed information (such as human or machine-readable indicia). In one embodiment, front segment 16 and rear segment 18 are manufactured from a multi-layer film that functions as a heat-sealable foil, and that also desirably provides a barrier to gases and moisture (e.g., provides a hermetic seal).

Examples of suitable materials for sachet 12 include multi-layer films of polyethylene terephthalate, polyethylene, polypropylene (e.g., oriented polypropylene), aluminum foil, and combinations thereof. In some embodiments, sachet 12 may include multi-layer films of polyethylene terephthalate and polyethylene, multi-layer films of oriented polypropylene and polyethylene, multi-layer films of differently oriented polypropylenes, and the like. Additional examples of suitable materials for sachet 12 include multi-layer films commercially available under the trade designation "FASSON RAPID-ROLL" films from Avery Dennison Corporation, Pasadena, Calif.

Elastomer portion 14 extends from the sachet 12 and is formed of a relatively thin sheet of one or more elastomeric materials, and is conjoined with sachet 12 along a sheet-like bonding segment 22. In particular, bonding segment 22 overlaps with sachet 12 and is bonded to a rear surface of rear segment 18 adjacent to fold line 20. The overlapping region of bonding segment 22 and the rear surface of rear segment 18 is sufficient such that elastomer portion 14 does not separate from sachet 12 during use. For example, the overlap is generally about 3/16 or 1/4 inch or even 3/8 inch, but typically not over about one inch or more, or in some embodiments, not over about 3/4 inch or more.

Suitable elastomeric materials for elastomer portion 14 include thermoplastic elastomers, such as styrenic block co-polymers (e.g., styrene-butadiene styrene and styrene-ethylene-butylene styrene), olefinic elastomers (e.g., ethylene and polypropylene based polyvinyl chloride-based elastomers, urethanes, nylon, silicon, and the like. The elastomeric material(s) provide elastomer portion 14 with sufficient elasticity to be stretched and to bounce back from a stretched condition.

Elastomer portion 14 includes a relatively flexible portion that extends from bonding segment 22 to form expandable loop 24. Expandable loop 24 is formed about an open area or cut-out area 26 of the relative flexible portion of the elastomer portion 14. Expandable loop 24 is sized and shaped to provide sufficient expansion so expandable loop 24 can be secured about (i.e., stretched over) various articles or products (e.g., bottle 11) depending upon the desired application or use. Although FIGS. 1 and 2 illustrate a particular loop shape or design, application is not limited to the particular shape or design shown. For example, expandable loop 24 can be oval, round or elongate shape depending upon the desired application and such characteristics as the elasticity of elastomer portion 14, the width of the loop band and the size of open area 26.

The size, shape and dimensions of the expandable loop 24 desirably permits stretching of the loop to a size at least three times greater than a relaxed unstretched size. The relaxed unstretched opening may range from as little as about 1.5 inches up to illustratively 5 inches. In an illustrative embodiment, a width of a perimeter of the expandable loop 14 is in a range of about 1/10 inches (100 mils) to about 1/12 inches (50 mils) and a thickness of the expandable loop 14 is between about 0.012 inches (12 mils) and about 0.030 inches (30 mils).

As shown, the relatively flexible portion of elastomer portion 14 includes transition portion 28 disposed between bonding segment 22 and expandable loop 24. Accordingly, transition portion 28 extends from bonding segment 22, and expandable loop 24 extends from transition portion 28. In one embodiment, transition portion 28 may include a neck portion 29 that functions to disperse tension force created as a result of the stretching or expansion of expandable loop 24.

For example, as shown in FIG. 1, when expandable loop 24 is stretched to fit around a cap and neck of bottle 11, this results in tension forces on elastomeric portion 14. Transition portion 28 disperses the tension forces, which is desirable to reduce stress on the elastomer in flat bonding segment 22. The dimension and contour of the transition or neck portion 29 is designed based upon the size, shape and elastic characteristics of the expandable loop 24.

The interior portion of sachet 12 (not shown in FIG. 1 or 2) may be used to retain one or more samples for individual use. For example, as mentioned above, sachet 12 may retain flowable materials, such as sample(s) of lotions, condiments or other food products, powder-based samples (e.g., powdered flavorants), liquid flavorants, shampoos, conditioners, creams, perfumes, and the like. To retain the samples, sachet 12 includes lateral edges 30 and base edge 32, which, as discussed further below, are desirably sealed (e.g., heat sealed). In particular, front segment 16 may be sealed to rear segment 18 at lateral edges 30 and base edge 32. The seals between front segment 16 and rear segment 18 at lateral edges 30 desirably extend from the seal at base edge 32 up to fold line 20.

Because front segment 16 is integrally formed from the same article as rear segment 18, which is folded at fold line 20, an additional seal at the top edge of sachet 12 adjacent to fold line 20 is not required. This is beneficial for reducing processing steps and to reduce the risk of damaging the elastomeric material at bonding segment 22 (e.g., when heat sealing sachet 12). However, in alternative embodiments, sachet 12 may also be sealed at fold line 20. In further alternative embodiments, as discussed below, front segment 16 and rear segment 18 may be separate sheets that may be sealed or otherwise bonded adjacent to bonding segment 22, along with the seals at lateral edges 30 and base edge 32.

Sealing sachet 12 effectively prevents the retained sample from escaping sachet 12 during storage, transportation, and display. For example, in situations in which sachet 12 retains a hand lotion, the seals at lateral edges 30 and base edge 32, and the integral connection at fold line 20, prevent the hand lotion from escaping from sachet 12 until a user intends to open sachet 12. The user may then cut into or tear one or more portions of sachet 12 open to access the hand lotion retained therein. Accordingly, in some embodiments, one or more of lateral edges 30 and base edge 32 may include a line of weakness (e.g., tear line 34) to assist in tearing sachet 12 open. Upon opening sachet 12, the user may then press front segment 16 and rear segment 18 together to force the sample out of the torn opening in sachet 12 under the applied pressure.

The incorporation of sachet 12 in tag 10 allows tag 10 to provide a variety of samples that are otherwise not suitable for retention by a product tag. For example, the flowable characteristics of hand lotion effectively prevents conventional product tags from retaining such substances without the use of an external sample container suspended from the product tag. However, the use of external sample containers may increase the time and costs to manufacture and package the samples. Moreover, such external sample containers may be dislodged from the product tag during storage, transportation, or display. In comparison, tag 10 is suitable for effectively and conveniently storing, transporting, and displaying product samples, along with displays of product information, in a manner that reduces the risk of the sample from becoming separated from the product tag.

Figure 3:
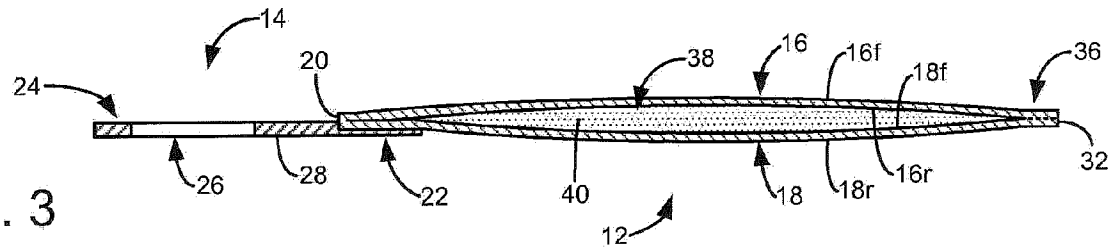
FIG. 3 is a sectional view of the product tag taken along Section 3-3 in FIG. 2.

As shown in FIG. 3, front segment 16 and rear segment 18 are formed of a single folded printable sheet, folded at fold line 20. Front segment 16 also includes front surface **16*f* and rear surface 16*r*, and rear segment 18 includes front surface 18*f* and rear surface 18*r*. As discussed above, front surface 18*f* of rear segment 18 is sealed to rear surface 16*r* of front segment 16, such as at sealed border 36. For example, front surface 18*f* and rear surface 16*r* are sealed at base edge 32 to define sealed border 36. On the opposing or top edge of sachet 12, however, front segment 16 and rear segment 18 are not sealed at fold line 20** due to the integral material of the folded printable sheet.

The material(s) of front segment 16 and rear segment 18 are desirably suitable for printing on their exterior surfaces to display information such as product information. Additionally, front segment 16 and/or rear segment 18 may be at least partially flexible and/or expandable to define interior portion 38 for retaining a sample, such as sample 40. Furthermore, the materials of front segment 16 and/or rear segment 18 may be opaque, translucent, transparent, or any suitable variation thereof.

Figure 4:
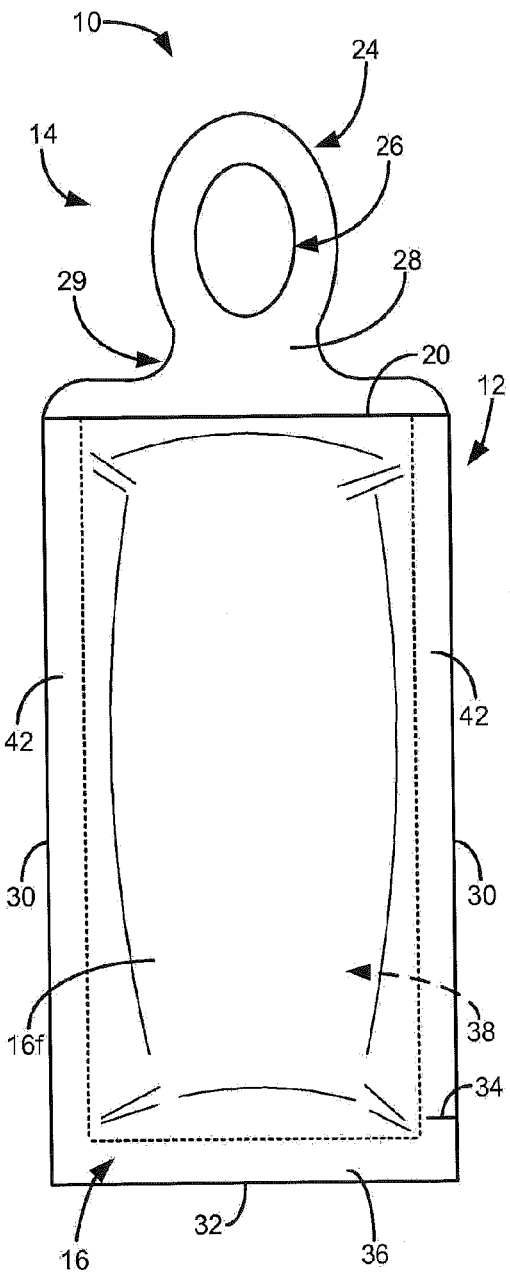
FIG. 4 is a front view of the product tag.

Front surface **18*f* of rear segment 18 is sealed to rear surface 16*r* of front segment 16 at lateral edges 30, as shown in FIG. 4, to provide sealed borders 42, which extend from sealed border 36 (at base edge 32) to fold line 20. The region between sealed borders 36 and 42 and fold line 20 accordingly define the perimeters of interior portion 38 for retaining sample 40 (shown in FIG. 3**).

As mentioned above, tear line 34 or other line of weakness may be formed at one or more of sealed borders 36 and 42. In these embodiments, tear line 34 desirably does not extend beyond sealed borders 36 and 42 into interior portion 38. This prevents sample 40 from escaping sachet 12 through tear line 34.

Figure 5:
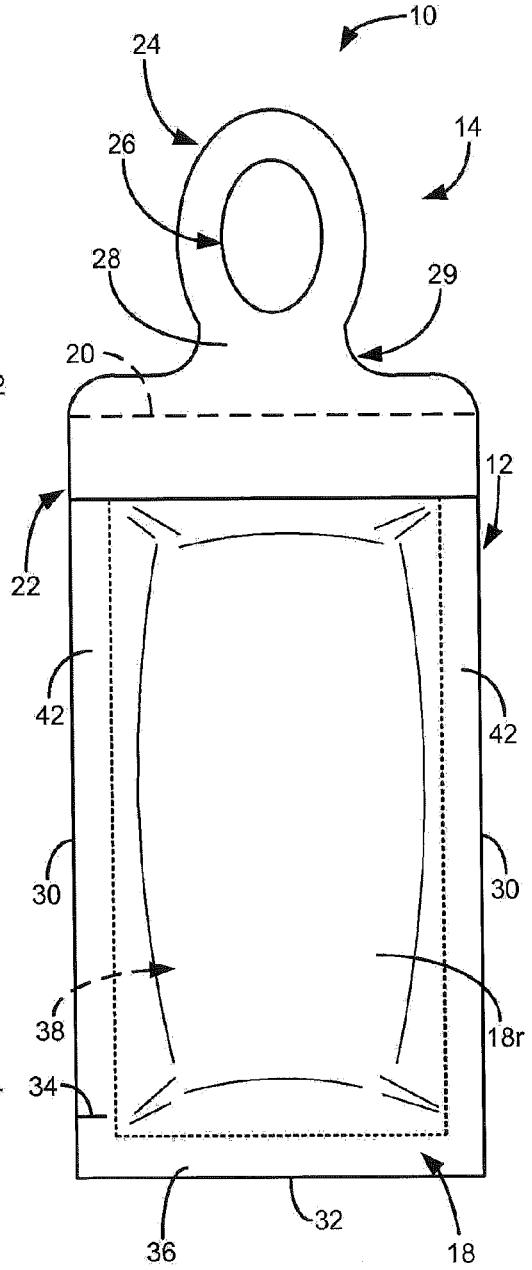
FIG. 5 is a rear view of the product tag.

As shown in FIG. 5, rear surface **18*r* may also provide a suitable location for presenting additional information at the rear side of tag 10. As further shown, bonding segment 22 is bonded to a portion of rear surface 18*r*, adjacent to fold line 20**.

Tag 10 may be manufactured using a variety of different techniques. FIGS. 6A-6H illustrate a suitable method for manufacturing multiple tags 10 using a web-based process. In the example shown in FIGS. 6A-6F, the multiple tags 10 may be manufactured in two opposing rows, which increases production volume. In the steps shown in FIGS. 6G and 6H, the two opposing rows may be separated into single rows for filling and subsequent sealing, as discussed below. In an alternative embodiment, the multiple tags 10 may be manufactured in a single row for the entirety of steps shown in FIGS. 6A-6H.

Figure 6A:
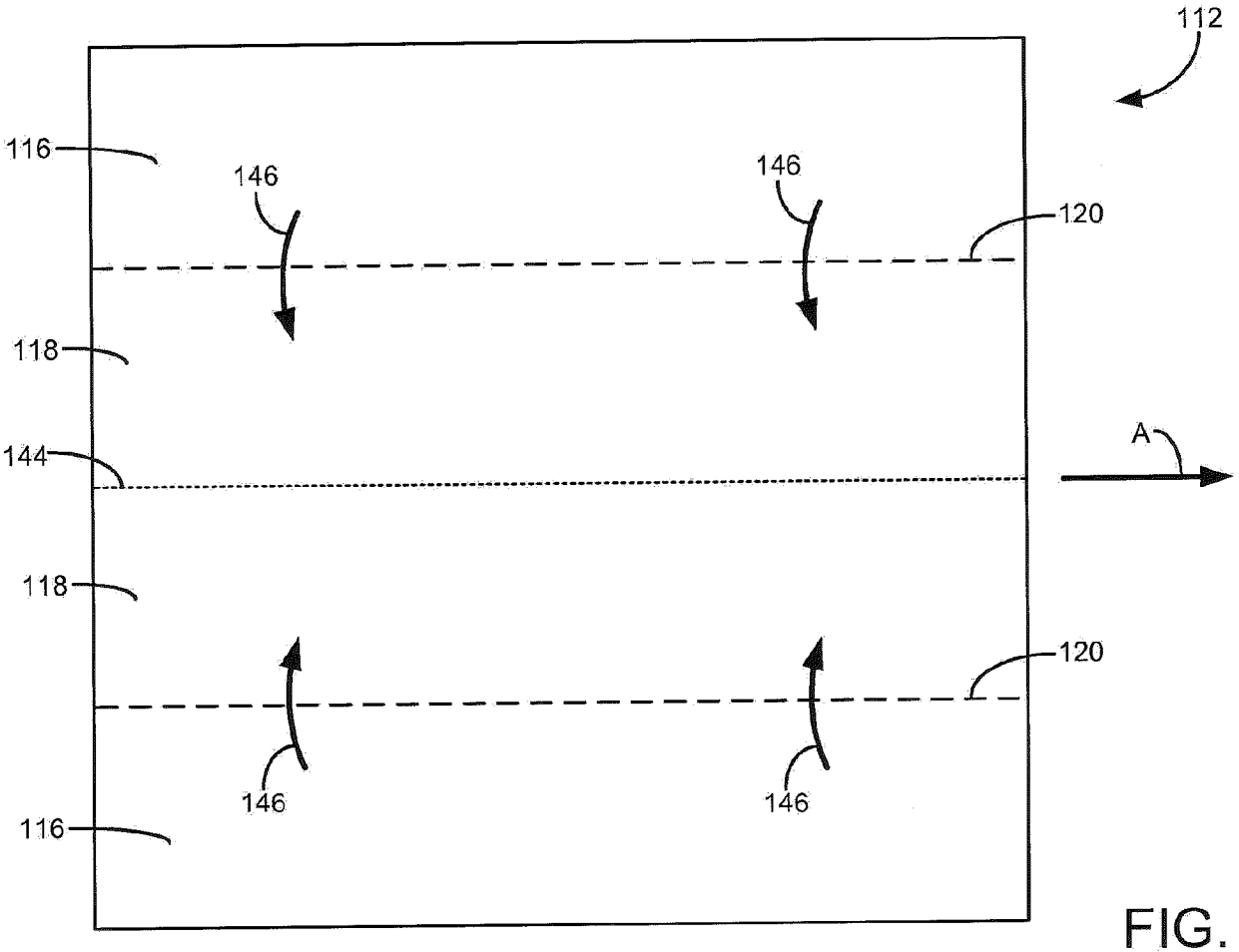
FIGS. 6A-6H are schematic illustrations of a web-based process for manufacturing multiple product tags of the present disclosure.

As shown in FIG. 6A, the process may initially involve advancing a web of a material for front segment 16 and rear segment 18 of sachet 12 in the direction of arrow A. For ease of discussion, the web of material for sachet 12 is referred to as sachet web 112, having segments 116 corresponding to front segments 16, and segments 118 corresponding to segments 18. Furthermore, sachet web 112 includes fold lines 120, which correspond to the fold lines 20 for the multiple tags 10. In some embodiments, web 112 may be pre-printed with indicia or other graphical designs on its front and/or rear surfaces.

In the shown embodiment, score line 144 or other line of weakness may be formed in web 112 in the direction of movement along arrow A. Score line 144 distinguishes the base ends of the opposing segments 118 and allows the opposing tags 10 to be separated. Segments 116 may also be folded over against segments 118 at fold lines 120, as illustrated by arrows 146.

Figure 6B:
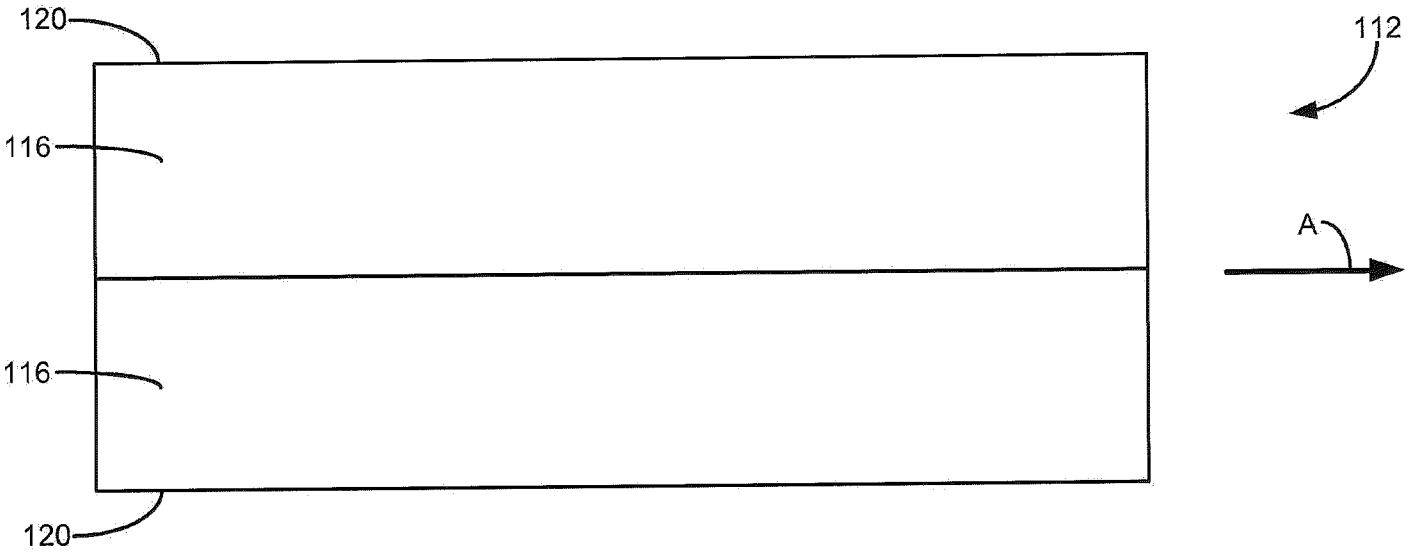
Figure 6C:
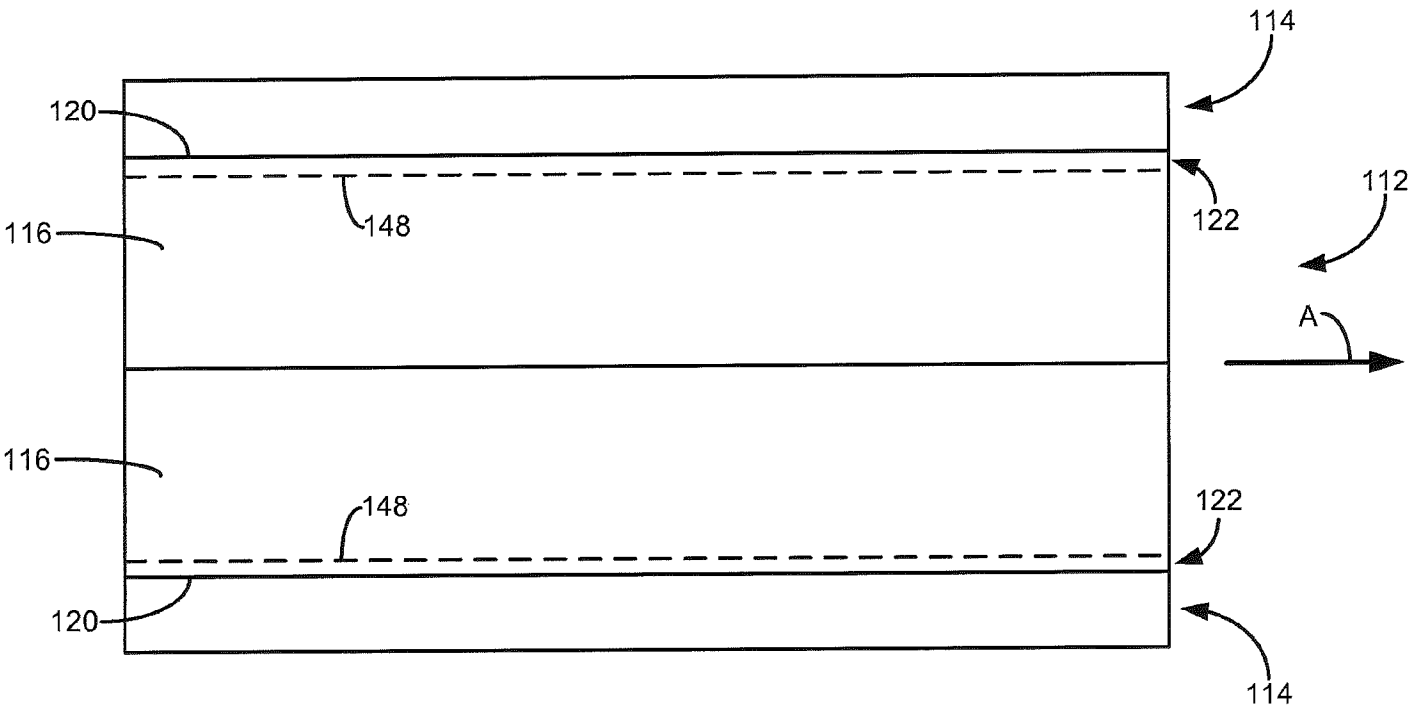
Figure 6D:
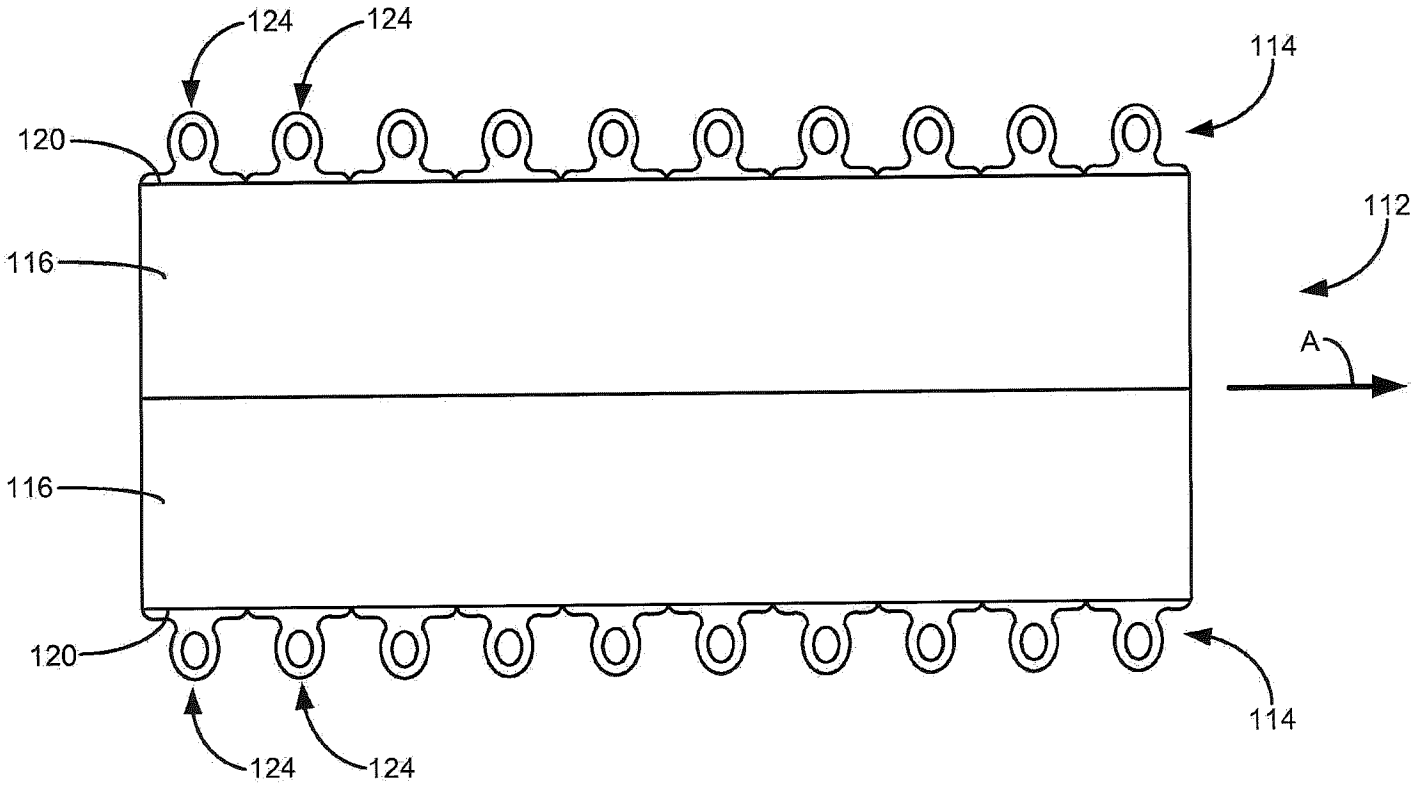

As shown in FIG. 6B, after segments 116 are folded over against segments 118 (along fold lines 120), the base ends of segments 116 face each other at the location of score line 144 (shown in FIG. 6A). As shown in FIG. 6C, films of elastomer materials (referred to as elastomer films 114) may then be laminated to the rear surfaces of segments 118 of sachet web 112 to form bond zones 122, ending at bonding zone edges 148 (shown with broken lines in FIG. 6C). Alternatively, films of elastomer materials may be laminated to the front surfaces of segments 116 of sachet web 112 to form bond zones 122 (which would invert the front and rear orientations of the product tags). Bond zones 122 correspond to bonding segments 22 for multiple tags 10. As shown in FIG. 6D, elastomer films 114 may then be cut or otherwise shaped to form multiple expandable loops 124, which correspond to expandable loops 24 for the multiple tags 10 (the broken lines depicting bond zones 122 are omitted in FIG. 6D-6H).

Figure 6E:
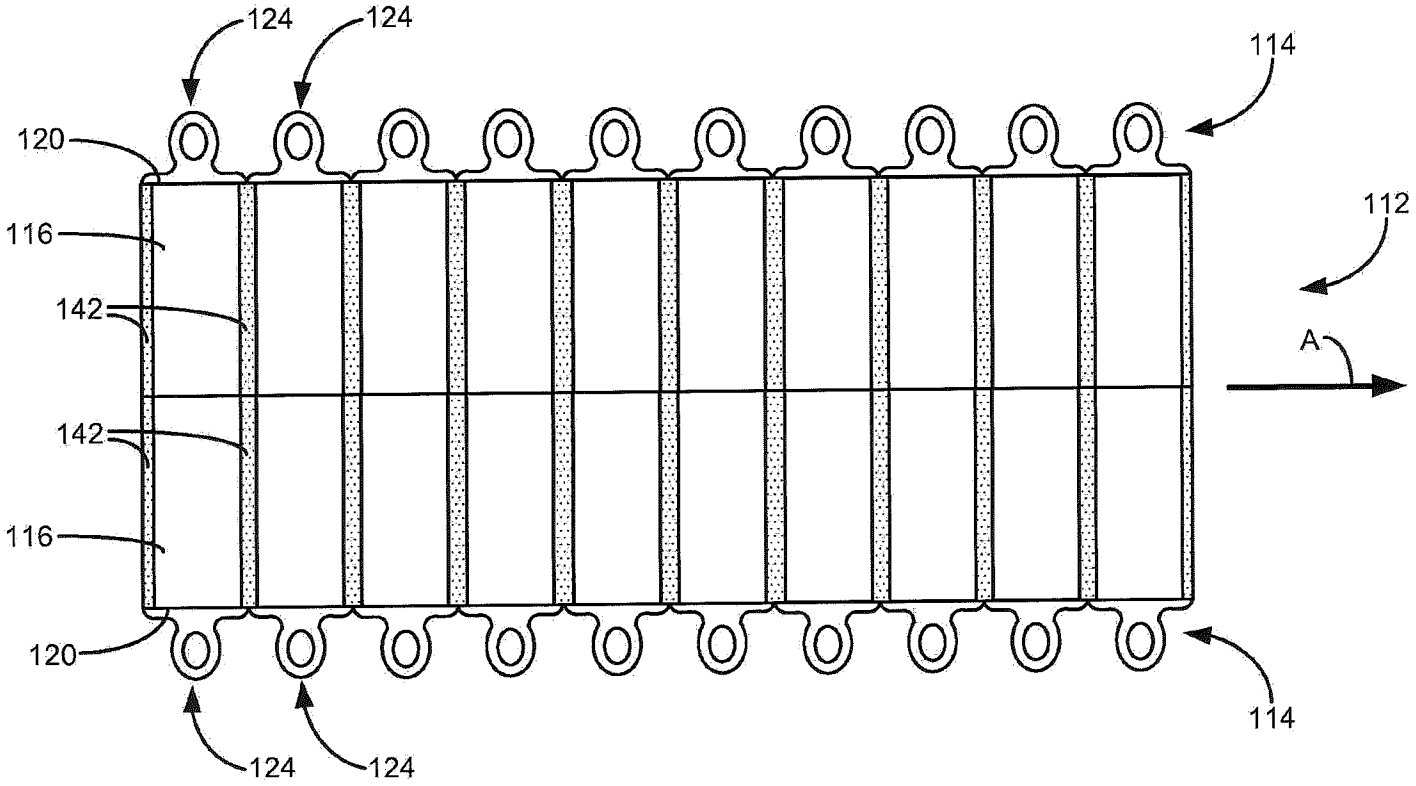

As shown in FIG. 6E, segments 116 may be sealed against segments 118 to form sealed regions 142 that correspond to sealed borders 42 of sachet 12 at lateral edges 30. In one embodiment, sealed regions 142 are formed by heat sealing segments 116 and 118 at the shown locations, such as with a heated annular die roller or a heated die press. The extent of the heat sealing may vary depending on the materials used for sachet web 112. However, the heat sealing desirably provides a good heat seal bond at seal regions 142 that prevent delamination under normal conditions of use, and also desirably provides a gas and moisture barrier.

In alternative embodiments, tie layers may be used to provide adhesive bonding in addition to, or as an alternative to heat sealing. In further alternative embodiments, other suitable sealing techniques, such as ultrasonic sealing, may be used. Heat sealing segments 116 and 118 in this manner seals the lateral edges 30 of each tag 10, but leaves the base edges 32 of the tags 10 open to allow material samples to be introduced into the interior portion 38 of each tag 10.

While illustrated with the particular steps shown in FIGS. 6A-6E, the above-discussed manufacturing process may alternatively be performed in different orders. For example, the sealing step shown in FIG. 6E may be performed prior to the lamination and loop formation steps shown in FIGS. 6C and 6D.

Figure 6F:
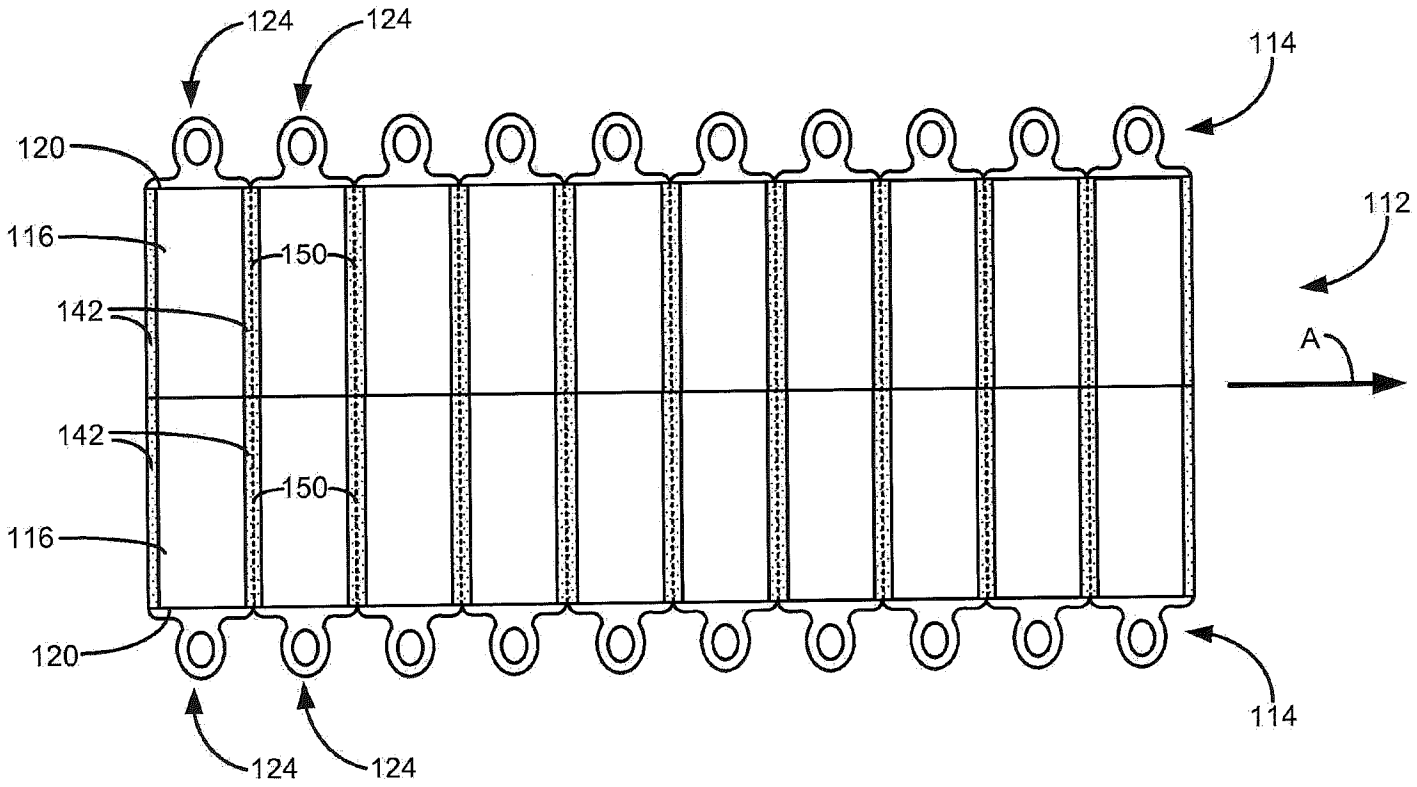

As shown in FIG. 6F, the formed advancing web may then be cut, perforated, or otherwise marked to provide score lines 150 or other lines of weakness, which, along with score line 144 (shown in FIG. 6A), may be used to separate the web into individual tags 10. In particular, score lines 150 are formed along sealed regions 142, thereby dividing a particular sealed region 142 into sealed borders 42 of adjacent tags 10. Additionally, lines of weakness may be formed in sealed borders 42 to form tear lines (not shown) corresponding to tear line 34 (shown in FIGS. 1, 2, 4, and 5).

At this point, the resulting web of partially-formed tags 10 may be maintained in sheet or roll form for bulk shipping to a customer for filling and sealing. For example, a manufacturer that performs the manufacturing process for the steps shown in FIGS. 6A-6F may not necessarily be the same entity that fills the partially-formed tags 10 with the samples. As such, in this embodiment, the partially-formed tags 10 may be maintained in sheet or roll form and shipped to the customer. The customer may then fill and seal the tags 10, and then prepare the resulting tags 10 for commercial use on products.

Alternatively, the manufacturer that performs the manufacturing process for the steps shown in FIGS. 6A-6F may also perform the filling and sealing steps, and then ship the resulting tags 10 in sheet form, or as separated individual tags 10, to the customer for commercial use on products. For example, the customer may send bulk quantities of the desired samples to the manufacturer, and the manufacturer may then form, fill, and seal the multiple tags 10.

Figure 6G:
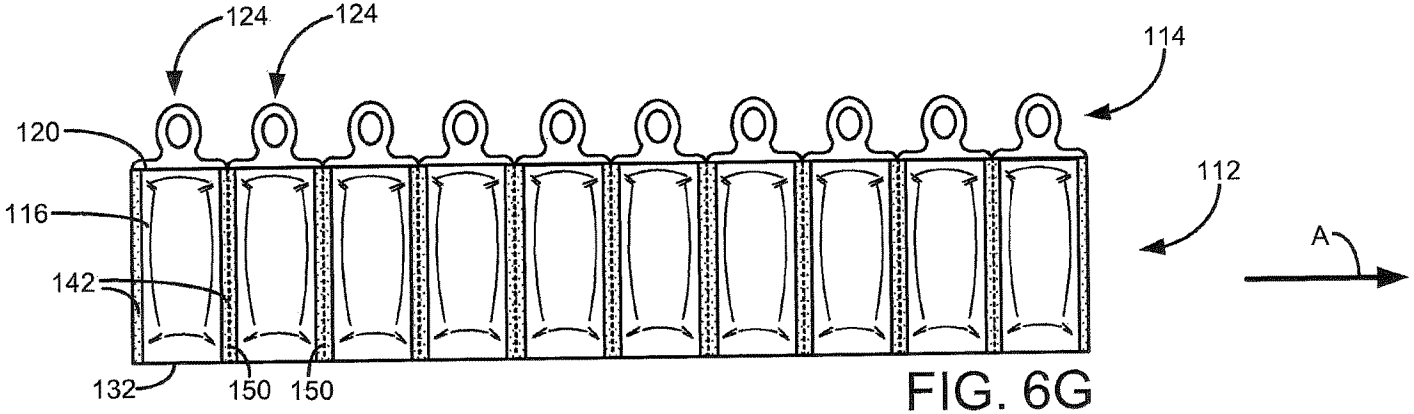
Figure 6H:
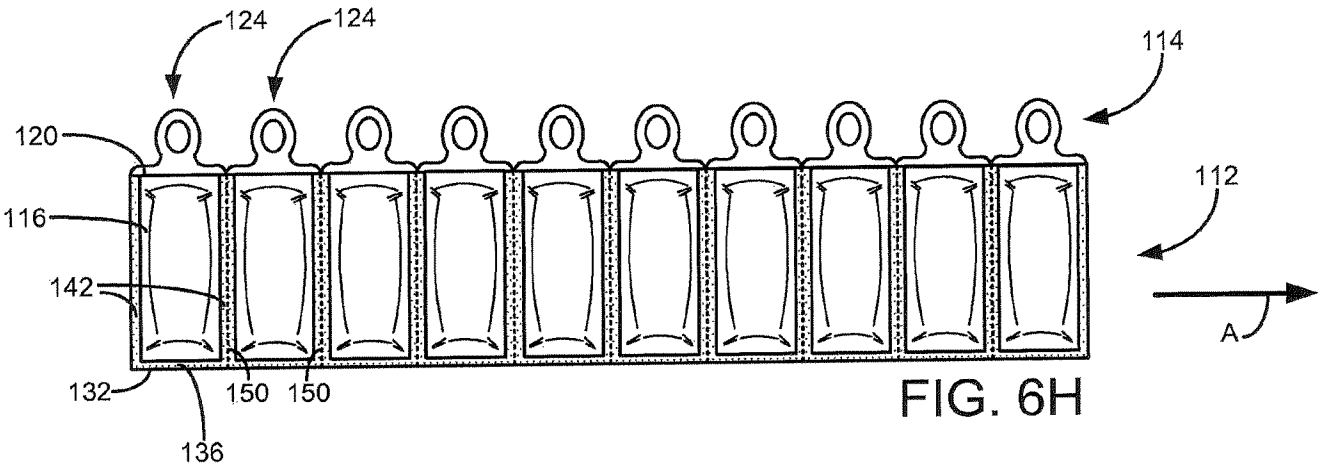

FIGS. 6G and 6H illustrate a suitable process for filling and sealing tags 10. As shown in FIG. 6G, the webs of tags 10 may be separated at score line 144 into the separate rows of multiple tags 10. In this embodiment, the individual tags 10 are desirably retained in web form along score lines 150. This arrangement provides base edge 132, which corresponds to base edge 32 for multiple tags 10, in a non-sealed state.

The desired sample (or samples) may then be successively injected or otherwise introduced into the interior portions of the multiple tags 10 through the unsealed openings at base edge 132. The amount of the sample introduced into each interior portion may be predetermined based on the composition of the sample and the dimensions of the interior portions. In some embodiments, the samples may be introduced into the interior portions of tags 10 in an inert environment (e.g., argon and/or nitrogen atmosphere) to reduce the risk of exposing the sample to oxygen during storage. Alternatively, a vacuum may be pulled to remove air from the interior portions during or after introducing the sample into the interior portions, thereby further reducing the risk of entraining gas bubbles in the samples.

As shown in FIG. 6H, after the samples are introduced, segments 116 may be further sealed against segments 118 to form sealed regions 136 that correspond to sealed region 36 of sachet 12 at base edge 32/base edge 132. Suitable techniques for forming sealed regions 136 include those discussed above for sealed regions 142 (e.g., heat sealing). The resulting tags 10 may then be separated for individual use, or maintained in sheet or roll form for bulk shipping and subsequent use.

Figure 7:
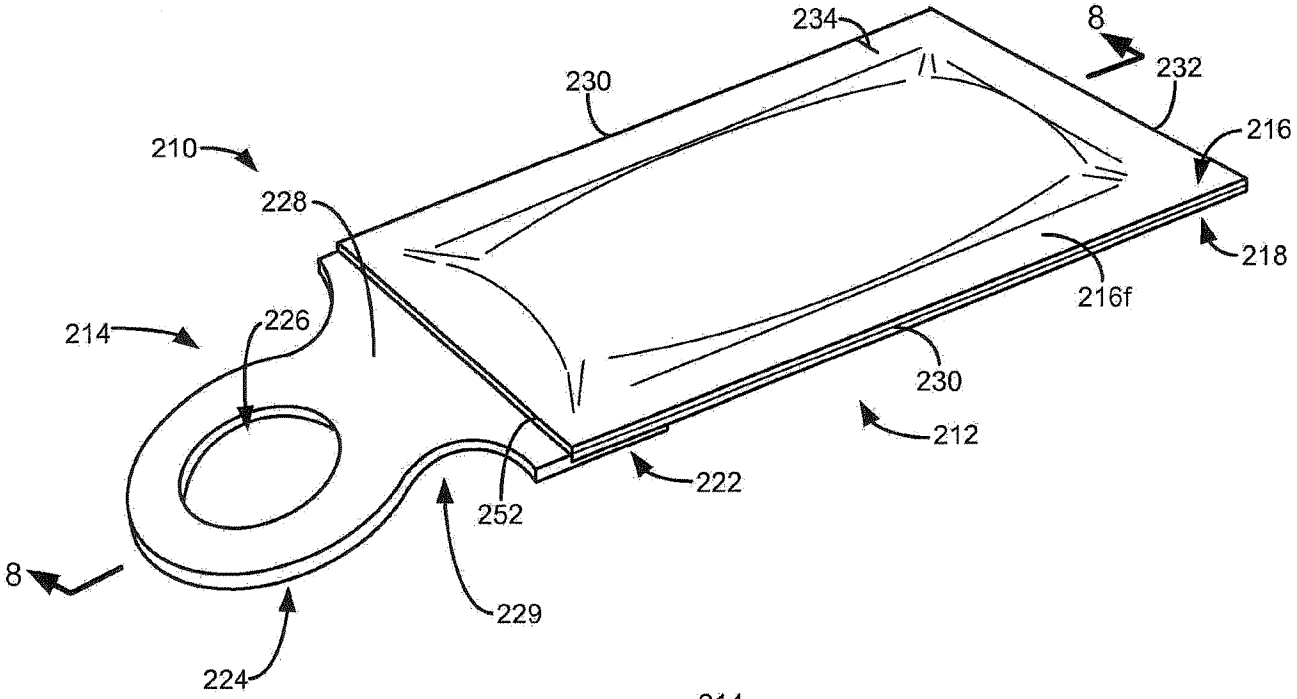
FIG. 7 is a perspective illustration of a first alternative product tag of the present disclosure having an expandable loop and a sachet portion, where the sachet portion is formed from separate sheet segments.

FIGS. 7-10 illustrate tag 210, which is an alternative to tag 10 (shown in FIGS. 1-5 and 6A-6H), and where corresponding references labels are increased by "200". As shown in FIG. 7, in this embodiment, sachet 212 of tag 210 is manufactured from front segment 216 and rear segment 218, which are separate components that are not integrally connected at a fold line corresponding to fold line 20. Instead, front segment 216 and rear segment 218 are sealed at top edge 252 of sachet 212, where top edge 252 is located adjacent to bonding segment 222.

Figure 8:
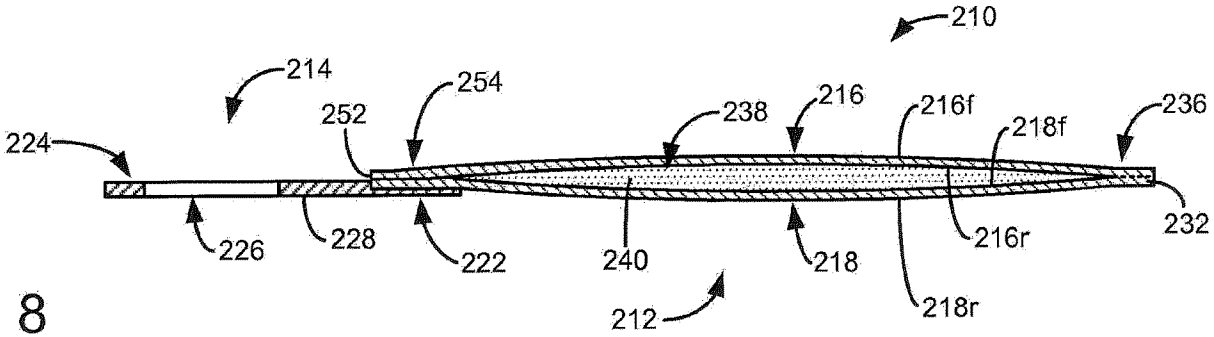
FIG. 8 is a sectional view of the first alternative product tag taken along Section 8-8 in FIG. 7.
Figure 9:
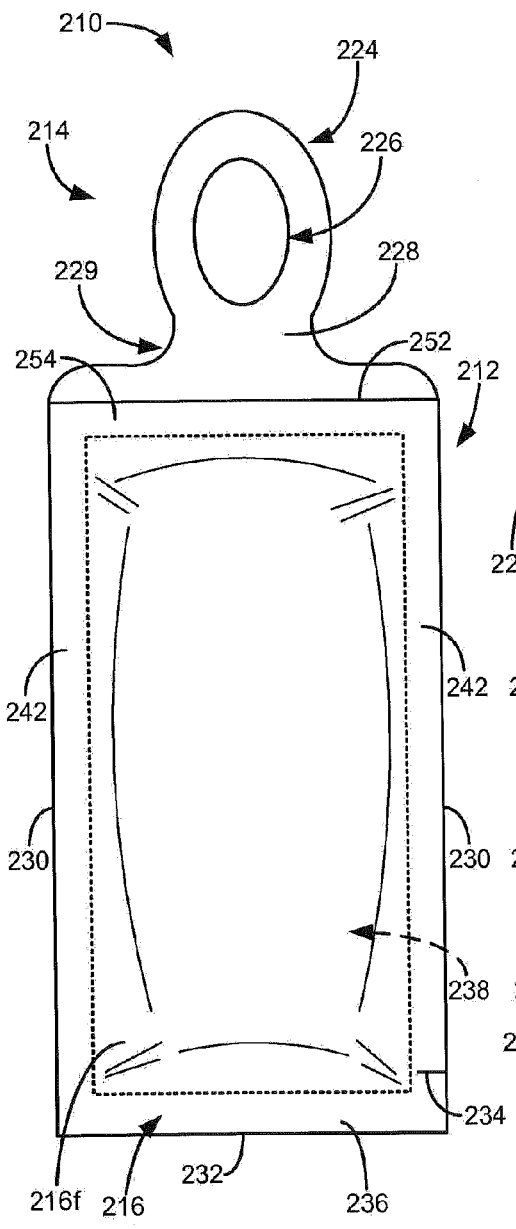
FIG. 9 is a front view of the first alternative product tag.

As shown in FIG. 8, front segment 216 and rear segment 218 are sealed at top edge 252 to define sealed border 254. This is in addition to sealed border 236 at base edge 232. As shown in FIG. 9, front segment 216 and rear segment 218 are also sealed at lateral edges 230 to provide sealed borders 242, which extend from sealed border 236 (at base edge 232) to sealed border 254 (at top edge 252). The region between sealed borders 236, 242 and 252 accordingly define the perimeters of interior portion or cavity 238 for retaining sample 240 (shown in FIG. 8).

Figure 10:
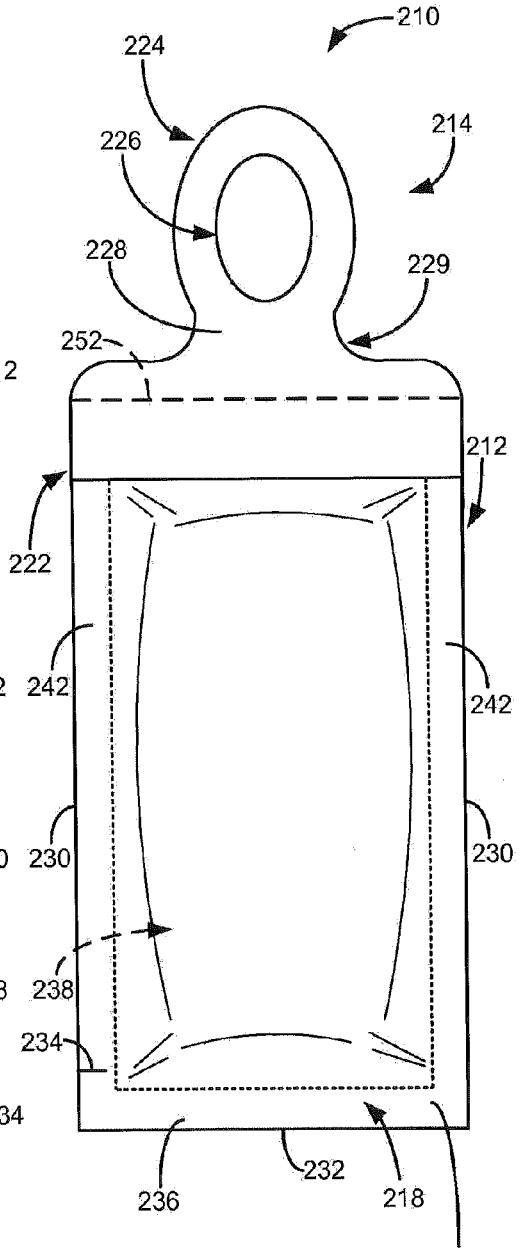
FIG. 10 is a rear view of the first alternative product tag.

As shown in FIG. 10, rear surface **218*r* of rear segment 218 may also provide a suitable location for presenting additional information at the rear side of tag 210. As further shown, bonding segment 222 is bonded to a portion of rear surface 218*r*, adjacent to top edge 252**.

Tag 210 may also be manufactured using a variety of different techniques. For example, tag 210 may be manufactured in a similar manner to the method for manufacturing tag 10 (shown in FIGS. 6A-6H). In this embodiment, however, a web of the material for rear segment 218 may initially be fed in a continuous manner. Since sachet 212 is formed from separate segments, a folding step corresponding to the step shown in connection with FIGS. 6A and 6B is not required.

Films of elastomer materials may then be laminated to the rear surfaces of the web of the rear segment 218 to form bond zones 222 in the same manner as discussed above for bond zones 122 (shown in connection with FIG. 6C). The elastomer films may then be cut or otherwise shaped to form multiple expandable loops corresponding to expandable loops 224 for the multiple tags 210, using the same process as discussed above for expandable loops 124 (shown in FIG. connection with 6D).

At this point in the process, the manufacturer may supply the partially-manufactured tags 210 in a roll or sheet form to the customer for subsequent processing. Alternatively, the manufacturer may perform all of the manufacturing steps, as discussed above for tag 10. In either situation, a web of the material for front segment 216 may then be laminated onto front side of the web of the material for rear segment 218. The webs may then be sealed together to form sealed regions that correspond to sealed borders 242 of sachet 212 at lateral edges 230 in a similar manner to that shown in FIG. 6E. Additionally, the webs may then be sealed together to form sealed regions that correspond to sealed borders 254 at top edges 252.

The formed advancing web may then be cut, perforated, or otherwise marked to provide score lines or other lines of weakness, which may be used to separate the web into individual tags 210, following the same process as used for tags 10 (shown in connection with FIG. 6F). The tags 210 may then be filled and sealed following the process as used for tags 10 (shown in connection with FIGS. 6G and 6H). The resulting tags 210 may then be separated for individual use or maintained in sheet form for bulk shipping and subsequent use.

As discussed above, each product tag of the present disclosure (e.g., tags 10 and 210) may be used for a variety of purposes, such as a product tag for labeling food products or other retail products, for providing samples of related retail products (e.g., conditioner samples attached to shampoo products) as well as gift tags for packages. Sachets 12 and 212 are accordingly suitable for displaying information relating to one or more products, such as printed indicia, graphics, and machine-readable information. In addition, sachets 12 and 212 may securely retain a sample of the product, such as samples of lotions, condiments or other food products, powder-based samples (e.g., powdered flavorants), liquid flavorants, shampoos, conditioners, creams, perfumes, and the like. This allows users to sample the intended product that tag 10 or tag 210 is secured to, as well as read displayed information relating to the product.

FIGS. 11-14 illustrate tag 310, which is an additional alternative embodiment to tags 10 and 210, where the corresponding reference labels are increased by "300" from those used for tag 10 and by "100" from those used for tag 210. In comparison to tags 10 and 210, tag 310 is configured to fold up upon itself to secure small samples, such as small sample bottles of retail products.

Figure 11:
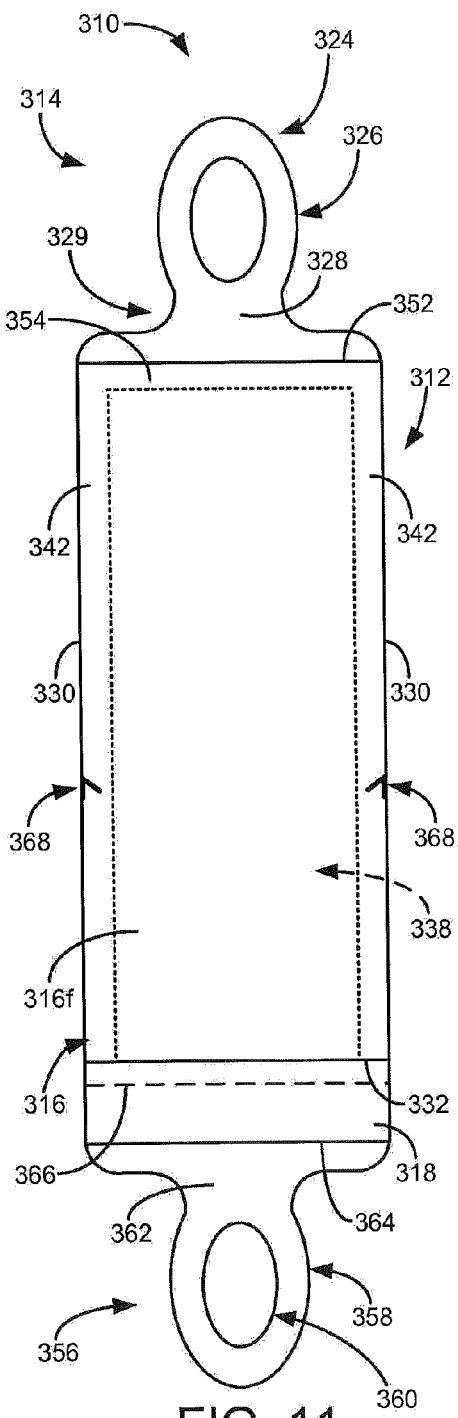
FIG. 11 is a front view of a second alternative product tag of the present disclosure having two expandable loops and a pocket portion.

As shown in FIG. 11, tag 310 includes pocket portion 312 and elastomer portion 314, where pocket portion 312 is suitable for retaining one or more samples or small retail products. This allows tag 310 to display information on pocket portion 312, such as information relating to a product, and include samples or portions of the retail product (or related products) within pocket portion 312. Pocket portion 312 includes front segment 316 and rear segment 318, which are sealed together at sealed borders 342 (at lateral edges 330) and at sealed border 354 (at top edge 352). In an alternative embodiment, front segment 316 and rear segment 318 may be bi-fold segments formed from a single sheet and folded at a fold line (not shown) corresponding to fold line 20 of tag 10.

Front segment 316 and rear segment 318 may be derived from one or more polymeric and/or metallic materials, and are desirably suitable for receiving printed information. Examples of suitable materials for front segment 316 and rear segment 318 include those discussed above for front segment 16 and rear segment 18 of tag 10.

Elastomer portion 314 extends from pocket portion 312 adjacent to top edge 352. Elastomer portion 314 is formed of a relatively thin sheet of one or more elastomeric materials, and is conjoined with pocket portion 312 along a sheet-like bonding segment in the same manner as discussed above for elastomer portion 14 of tag 10.

In addition, tag 310 also includes elastomer portion 356, which extends from pocket portion 312 adjacent to base edge 332. Elastomer portion 356 includes a relatively flexible portion that extends from a bonding segment to form expandable loop 358. Expandable loop 358 is formed about an open area or cut-out area 360 of the relative flexible portion of the elastomer portion 356.

Expandable loop 358 is sized and shaped to provide sufficient expansion so expandable loop 358 can be secured about (i.e., stretched over) pocket portion 312, as discussed below. Although FIGS. 11-14 illustrate a particular loop shape or design, application is not limited to the particular shape or design shown. For example, expandable loop 358 can be oval, round or elongate shape depending upon the desired application and such characteristics as the elasticity of elastomer portion 356, the width of the loop band and the size of open area 360.

As shown, the relatively flexible portion of elastomer portion 356 includes transition portion 362 disposed between the bonding segment and expandable loop 358. In one embodiment, transition portion 362 may include neck portion 363 that functions to disperse tension force created as a result of the stretching or expansion of expandable loop 358. Dissipation of the tension forces is desirable to reduce stress on the elastomer in the bonding segment. The dimension and contour of the transition portion 362 and neck portion 363 are designed based upon the size, shape and elastic characteristics of the expandable loop 358.

As further shown, base edge 364 of rear segment 318 extends further from top edge 352 than base edge 332 of front segment 316, thereby providing a suitable location for securing elastomer portion 356 to rear surface 318*r* of rear segment 318. In the shown example, front segment 316 is not sealed to rear segment 318 for at least a portion of base edge 332, thereby allowing access within interior region or cavity 338 of pocket portion 312 at base edge 332.

Rear segment 318 also includes fold or crush crease 366, which, in the shown embodiment, is located between base edge 332 of front segment 316 and base edge 364 of rear segment 318. As discussed below, crush crease 366 is configured to be folded upon such that elastomer portion 356 is folded upwards to allow expandable loop 358 to wrap around pocket portion 312.

Front segment 316 and rear segment 318 also desirably include slots 368 at one or both of lateral edges 330, within sealed borders 342. As discussed below, slots 368 provide suitable locations for receiving and retaining expandable loop 358 when expandable loop 358 wraps around pocket portion 312.

Figure 12:
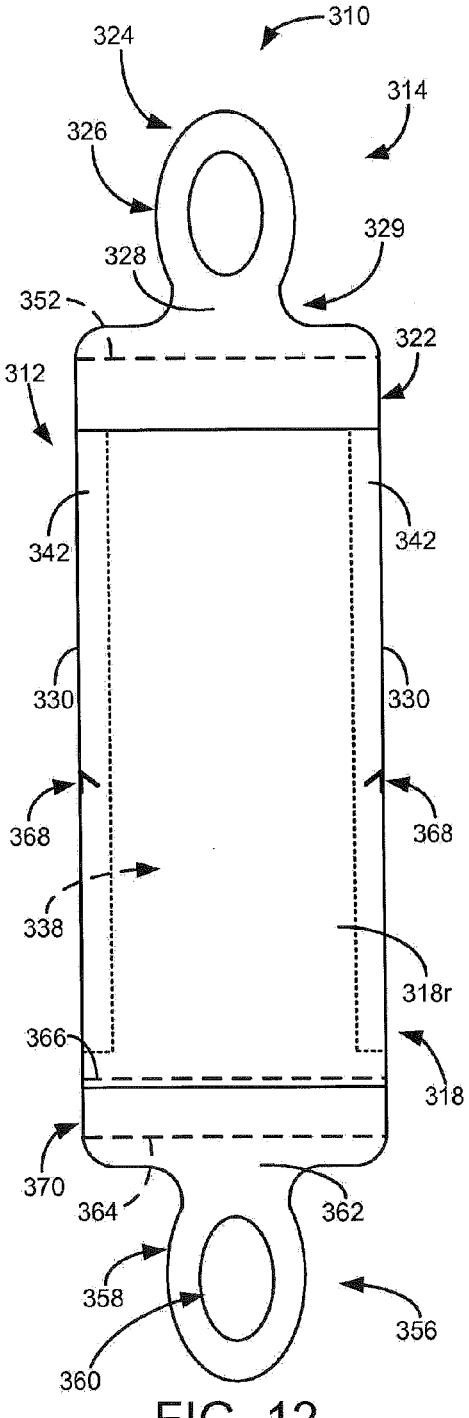
FIG. 12 is a rear view of the second alternative product tag.

As shown in FIG. 12, rear surface 318*r* of rear segment 318 may also provide a suitable location for presenting additional information at the rear side of tag 310. As further shown, bonding segment 322 of elastomer portion 314 is bonded to a portion of rear surface 318*r*, adjacent to top edge 352, and bonding segment 370 of elastomer portion 356 is bonded to a portion of rear surface 318*r* adjacent to base edge 364. In the shown embodiment, bonding segment 370 desirably does not extend across crush crease 366, thereby allowing crush crease 366 to be folded during use.

Tag 310 may also be manufactured using a variety of different techniques. For example, tag 310 may be manufactured in a similar manner to the method for manufacturing tag 10 (shown in FIGS. 6A-6H), where elastomer portion 356 may be formed and shaped along with elastomer portion 314, and where base edge 332 of front segment 316 desirably remains partially unsealed from rear segment 318 for access to interior region 338.

As shown in FIG. 13, tag 310 may be used to retain a variety of different items, such as sample bottle 372. During use, bottle 372 may be inserted into interior region 338 through the opening between front segment 316 and rear segment 318 at base edge 332 (shown in FIG. 11). Elastomer portion 356 may then be folded upward at crush crease 366, and expandable loop 358 may be stretched open. Elastomer portion 314 and pocket portion 312 may then be inserted through the stretched-open expandable loop 358 until expandable loop 358 extends around pocket portion 312 (retaining bottle 372). Expandable loop 358 may then be allowed to contract around pocket portion 312 and bottle 372, and may be inserted into slots 368 to retain expandable loop 358 around pocket portion 312.

This arrangement, which is further illustrated in FIG. 14, allows the opening into interior region 338 at base edge 332 to be effectively closed due to the folding of rear segment 318 and elastomer portion 356 at crush crease 366. This closure, in combination with the contracted grip of expandable loop 358 around pocket portion 312 and bottle 372 efficiently retains bottle 372 within pocket portion 312. When a user desires to obtain bottle 372, the user may stretch and pull expandable loop 358 over pocket portion 312 and elastomer portion 314 to open the access to interior region 338 at base edge 332. The user may then readily remove bottle 372 from interior region 338

While illustrated in use with bottle 372, tag 310 may be used with a variety of different articles, such as product samples. For example, tag 310 may retain bottles or other containers of product samples (e.g., lotions, lip balm, and the like). Alternatively, tag 310 may retain retail articles that are small enough to fit within interior region 338, while also being large enough to prevent accidental leakage or spilling from within interior region 338. For example, tag 310 may retain sets of fasteners (e.g., screws, bolts, and the like). In this example, tag 310 may function as a package for the fasteners that may be hung from a display hook. During use, a user may open tag 310 to retrieve a desired number of the fasteners, and then re-close tag 310 to conveniently store the remaining supply of fasteners within interior region 338.

Although the present disclosure has been described with reference to several embodiments, workers skilled in the art will recognize that changes may be made in form and detail without departing from the spirit and scope of the disclosure.

The invention claimed is:

1. A product tag comprising:
- a sachet portion comprising:
  - a front segment having a front surface and a rear surface; and
  - a rear segment having a front surface and a rear surface, wherein the front surface of the rear segment is sealed to the rear surface of the front segment to define a sealed interior region having a perimeter, wherein the front segment and the rear segment are connected together about the entire perimeter; and
- a first elastomer portion comprising:
  - a first bonding segment bonded to the sachet portion;
  - a first transition portion extending from the first bonding segment; and
  - a first expandable loop extending from the first transition portion.

2. The product tag of claim 1, wherein the front segment and the rear segment are connected at a fold line, wherein the fold line defines a border of the sealed interior region.

3. The product tag of claim 1, wherein the perimeter is located at a periphery of the sachet portion to define sealed borders for the sealed interior region.

4. The product tag of claim 3, and further comprising a line of weakness at one of the sealed borders, wherein the line of weakness does not extend beyond the one sealed border into the sealed interior region.

5. The product tag of claim 1, and further comprising a flowable material retained within the sealed interior region.

6. The product tag of claim 1, wherein the sachet portion has a rectangular geometry with a top edge, a bottom edge, and lateral edges, wherein the front surface of the rear segment is sealed to the rear surface of the front segment at each of the top edge, the bottom edge, and the lateral edges.

7. The product tag of claim 1, wherein the front segment and the rear segment each comprise a multi-layer film.

8. The product tag of claim 1, wherein the first bonding segment is bonded to the rear surface of the rear segment.

9. The product tag of claim 1, wherein the sealed interior region is hermetically sealed.

10. A product tag including:
- a pocket portion including:
  - a front segment having a front surface and a rear surface; and
  - a rear segment having a front surface and a rear surface, wherein the front surface of the rear segment is sealed to the rear surface of the front segment to define a pocket having a perimeter, wherein the front segment and the rear segment are connected together about a major portion of the perimeter and wherein an opening remains at a minor portion of the perimeter to allow access to a cavity of the pocket; and
- a first elastomer portion including:
  - a first bonding segment bonded to the pocket portion;
  - a first transition portion extending from the first bonding segment; and
  - a first expandable loop extending from the first transition portion.

11. The product tag of claim 10, and further including:
- a second elastomer portion including:
  - a second bonding segment bonded to the pocket portion;
  - a second transition portion extending from the second bonding segment; and
  - a second expandable loop extending from the second transition portion.

12. The product tag of claim 11, wherein the rear segment includes a crush crease located on a portion of the rear segment not overlapped by the second bonding segment.

13. The product tag of claim 10, wherein the rear segment includes a crush crease located on a portion of the rear segment not overlapped by the front segment.

14. The product tag of claim 10, wherein the pocket portion has a rectangular geometry with a top edge, a bottom edge, and lateral edges, wherein the major portion of the perimeter includes the top edge and the lateral edges, and wherein the minor portion of the perimeter includes the bottom edge.

15. The product tag of claim 10, wherein:
- the front segment and the rear segment have a common width; and
- wherein the rear segment has a greater length than the front segment.

16. The product tag of claim 10, wherein the rear segment includes a crush crease.

17. The product tag of claim 10, wherein the pocket portion further includes a slot disposed on the major portion of the perimeter.

18. The product tag of claim 10, wherein at least one of the front segment and the rear segment includes a multi-layer film.

19. The product tag of claim 10, wherein the first bonding segment is bonded to the rear surface of the rear segment.

20. The product tag of claim 10, wherein the first bonding segment overlaps the pocket portion.

* * * * *